United States Patent [19]

Daniels

[11] 4,004,514

[45] Jan. 25, 1977

[54] ROLL RATE STABILIZED WRAP AROUND MISSILE FINS

[75] Inventor: Peter Daniels, Fredericksburg, Va.

[73] Assignee: The United States of America as represented by the Secretary of the Navy, Washington, D.C.

[22] Filed: Jan. 20, 1976

[21] Appl. No.: 650,639

[52] U.S. Cl. ..... 102/3; 244/3.29

[51] Int. Cl.[2] ..... F42B 13/32

[58] Field of Search ..... 102/3, 4; 244/3.23, 244/3.24, 3.27, 3.29

[56] References Cited

UNITED STATES PATENTS

| | | | |
|---|---|---|---|
| 2,793,591 | 5/1957 | Jasse | 244/3.29 |
| 3,111,088 | 11/1963 | Fisk | 244/3.23 |
| 3,260,205 | 7/1966 | Dietrich | 244/3.23 |
| 3,421,714 | 1/1969 | Koerner | 244/3.23 X |
| 3,697,019 | 10/1972 | Watson | 244/3.29 |
| 3,702,588 | 11/1972 | Simmons | 244/3.29 X |

FOREIGN PATENTS OR APPLICATIONS

| | | | |
|---|---|---|---|
| 1,104,534 | 11/1955 | France | 244/3.29 |

*Primary Examiner*—David H. Brown

[57] ABSTRACT

An air launched weapon having wrap-around fins wherein the fins are provided with fences, slots and roll tabs to stabilize the roll-rate at all angles of attack.

4 Claims, 2 Drawing Figures

ROLL RATE STABILIZED WRAP AROUND MISSILE FINS

BACKGROUND OF THE INVENTION

This invention relates generally to air dropped weapons such as bombs and rockets, and more particularly to weapons provided with wrap-around fins which are roll-rated stabilized.

Wrap-around fins of proper design have been found to avoid roll resonance and roll-yaw coupling thus alleviating two problems plaguing current general-purpose bombs and other air dropped weapons. However, a problem that is characteristic af wrap-around fin missile configurations is high roll-rate at high angles af attack. The elimination of high roll-rates is an important factor in controlling Magnus instability of air launched weapons, particularly bombs, as was painted out in Applicant's earlier U.S. Pat. No. 3,392,934.

SUMMARY OF THE INVENTION

The present invention obviates the disadvantages af prior art devices by providing fin fences and slots on wrap-around fins. The fences serve to equalize the drag differential between retreating and advancing fins when rotating in a crossflow. The slots changes shedding of vortices to provide passive roll-rate stabilization at high angles af attack. Roll tabs are provided to produce a desired roll-rate for stabilization purposes.

DESCRIPTION OF THE PREFERRED EMBODIMENT

Figure 1:
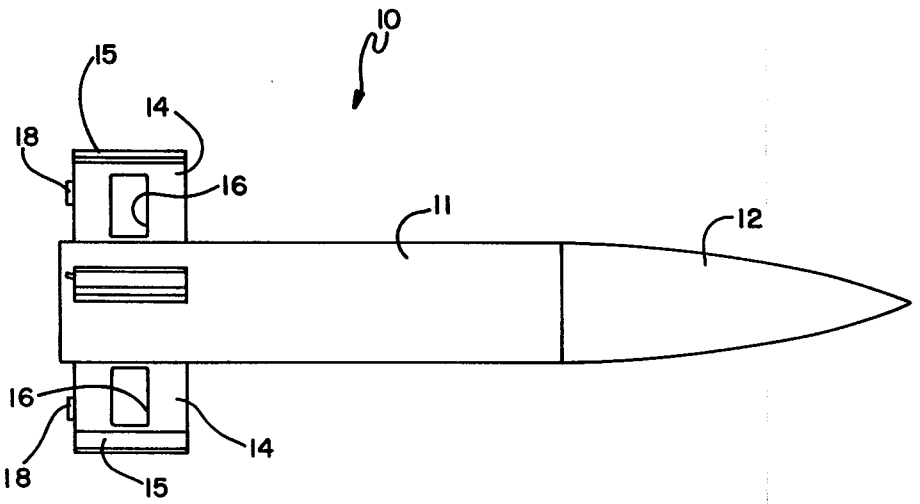
FIG. 1 is a side view of an air dropped weapon provided with the wrap-araund fins of the present invention and showing the fins in their operative positions.
Figure 2:
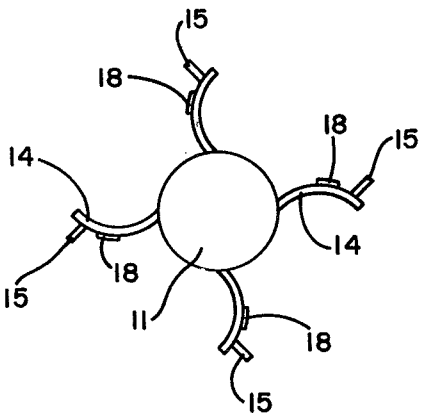
FIG. 2 is an aft view of the weapon illustrated in FIG. 1.

Referring now to the drawings there can be seen an air dropped weapon, designated generally by the reference numeral 10, having a body section 11 and an ogive section 12. A plurality of wrap-around fins 14, shown in their deployed positions, are mounted on the after end of the body section 11. The weapon 10 may be provided with any suitable warhead and fuze as well as any appropriate means for stowing and deploying the wrap-around fins since specific details of these elements of the weapon 10 form no part of the present invention.

Each fin 14 is provided with a fence 15 fixed to the convex side of the fin adjacent the outer extremity thereof and parallel to the longitudinal axis of the weapon 10. A slot 16 is formed in each fin 14 in a generally central location. A roll tab 18 is fixed to the aft edge of each fin 14 to provide a predetermined stabilizing roll rate.

The present invention was extensively wind tunnel tested. The basic wrap-around fin configuration was first tested and found to exhibit large, negative, steady-state roll rates at high angles of attack. For comparison purposes a cruciform fin configuration with the same planform as the basic wrap-around fin configuration was also tested. As expected, this configuration exhibited roll speed-up in both the positive and negative directions.

It had been shown in applicant's aforementioned patent that fin slots eliminated roll speed-up of cruciform finned weapons. Consequently, centrally located fin slots were tested on the basic wrap-around fin configuration. The ratio of slot area to fin area ($c/C$) was approximately 0.3. The slots resulted in a reduction in roll rates at high angles of attack by about 50%. This reduction, while encouraging, indicated a need for additional modifications of the fins to obtain roll rate stablization.

Since wrap-around fin configurations are not symmetrical, in roll, i.e., retreating and advancing fins when rotating in a cross-flow would produce different amounts of drag, it was concluded that part of the high angle of attack roll rate might be produced by differential drag. Accordingly, unslotted wrap-around fins were treated with fences fixed at various positions adjacent the outer ends of the fins. These configurations allowed roll at lower, but still excessive, rates in either direction.

The final configurations tested employed both slots and fences. Roll tabs were added to the aft ends of the fins to provide the required driving torque. These configurations were found to eliminate excessive roll in either direction and provide roll rate stabilization in incompressible flow.

Obviously many modifications and variations of the present invention are possible in the light of the above teachings. It is therefore to be understood that within the scope of the appended claims the invention may be practiced otherwise than as specifically described.

What is claimed is:

1. An air dropped weapon having a warhead, tail-mounted, wrap-around fins and means for stowing and deploying the fins wherein the improvement comprises:

a fence mounted on the convex side of each fin adjacent the outer extremity thereof for balancing differential drag caused by the asymmetrical roll configuration; and a slot provided in each fin to cause each fin to change vortices at high angles of attack whereby roll-rate stabilization is obtained.

2. An air dropped weapon as defined in claim 1 wherein a roll tab is mounted on the aft end of each fin to produce stabilizing roll at a predetermined rate.

3. An air dropped weapon as defined in claim 1 wherein the ratio of slot area to fin area is approximately 0.3.

4. An air dropped weapon as defined in claim 2 wherein the ratio of slot area to fin area is approximately 0.3.

* * * * *